US008316503B2

(12) United States Patent
Follows et al.

(10) Patent No.: US 8,316,503 B2
(45) Date of Patent: Nov. 27, 2012

(54) CLEANER HEAD

(75) Inventors: Thomas James Dunning Follows, Malmesbury (GB); Stephen Benjamin Courtney, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 317 days.

(21) Appl. No.: 12/791,640

(22) Filed: Jun. 1, 2010

(65) Prior Publication Data

US 2010/0306956 A1 Dec. 9, 2010

(30) Foreign Application Priority Data

Jun. 9, 2009 (GB) ..... 0909898.9

(51) Int. Cl.
*A46B 13/00* (2006.01)

(52) U.S. Cl. ..... 15/179; 15/183; 15/207.2; 15/383

(58) Field of Classification Search ..... 15/1.51, 15/179–183, 200, 207.2, 383, 398, 141.2, 15/198; *A46B 7/10, 3/08*

See application file for complete search history.

(56) References Cited

U.S. PATENT DOCUMENTS

| | | | | | |
|---|---|---|---|---|---|
| 2,281,863 | A | * | 5/1942 | Smellie | 15/183 |
| 2,426,315 | A | | 8/1947 | Marick | |
| 2,459,007 | A | | 1/1949 | Taylor | |
| 2,578,549 | A | * | 12/1951 | Hooban | 15/344 |
| 2,659,921 | A | | 11/1953 | Osborn | |
| 3,186,019 | A | | 6/1965 | Hattori | |
| 3,614,801 | A | * | 10/1971 | Peabody | 15/179 |
| 3,908,223 | A | | 9/1975 | Brooks et al. | |
| 4,186,030 | A | | 1/1980 | Armstrong | |
| 4,197,610 | A | | 4/1980 | Schneider | |
| 4,435,073 | A | | 3/1984 | Miller | |
| 4,706,320 | A | * | 11/1987 | Swift | 15/1.51 |
| 4,835,807 | A | | 6/1989 | Swift | |
| 5,150,499 | A | | 9/1992 | Berfield | |
| 5,187,526 | A | | 2/1993 | Zaretsky | |
| 5,452,490 | A | * | 9/1995 | Brundula et al. | 15/182 |
| 5,689,791 | A | | 11/1997 | Swift | |
| 5,701,633 | A | | 12/1997 | Jonischus | |
| 5,905,932 | A | | 5/1999 | Morse et al. | |
| 6,199,244 | B1 | | 3/2001 | Hilgers et al. | |
| 6,267,660 | B1 | | 7/2001 | Jespersen | |
| 6,539,575 | B1 | * | 4/2003 | Cohen | 15/179 |
| 2005/0039282 | A1 | | 2/2005 | Paterson et al. | |

(Continued)

FOREIGN PATENT DOCUMENTS

| | | |
|---|---|---|
| CN | 101090660 | 12/2007 |

(Continued)

OTHER PUBLICATIONS

International Search Report and Written Opinion mailed Sep. 13, 2010, directed to counterpart International Application No. PCT/GB2010/050853;13 pages.

(Continued)

*Primary Examiner* — Brian Glessner
*Assistant Examiner* — Brian D Mattei
(74) *Attorney, Agent, or Firm* — Morrison & Foerster LLP

(57) ABSTRACT

Agitating apparatus for a surface treating appliance includes a rotatable body having a plurality of grooves formed therein, an agitating member located within each groove so that at least one side edge of the agitating member protrudes outwardly from the body, and a connecting member located within each groove for connecting the agitating member to the body.

18 Claims, 7 Drawing Sheets

U.S. PATENT DOCUMENTS

| | | | | |
|---|---|---|---|---|
| 2005/0153558 | A1 | 7/2005 | Koh et al. | |
| 2005/0246857 | A1* | 11/2005 | Omoto et al. | 15/366 |
| 2008/0000043 | A1 | 1/2008 | Frederickson | |
| 2010/0306957 | A1 | 12/2010 | Follows et al. | |
| 2010/0306958 | A1 | 12/2010 | Follows et al. | |
| 2010/0306959 | A1 | 12/2010 | Follows et al. | |

FOREIGN PATENT DOCUMENTS

| | | |
|---|---|---|
| DE | 34 18 224 | 11/1984 |
| DE | 43 06 734 | 9/1994 |
| DE | 195 47 311 | 6/1997 |
| EP | 0 313 403 | 4/1989 |
| EP | 0 992 211 | 4/2000 |
| GB | 734360 | 7/1955 |
| GB | 1 360 309 | 7/1974 |
| GB | 2 090 124 | 7/1982 |
| GB | 2 135 869 | 9/1984 |
| GB | 2 150 422 | 7/1985 |
| GB | 2 425 715 | 11/2006 |
| JP | 51-163755 | 12/1976 |
| JP | 5-269059 | 10/1993 |
| JP | 5-317226 | 12/1993 |
| JP | 6-105771 | 4/1994 |
| JP | 7-327885 | 12/1995 |
| JP | 11-216088 | 8/1999 |
| JP | 2000-60775 | 2/2000 |
| JP | 2000-217753 | 8/2000 |
| JP | 2002-136457 | 5/2002 |
| JP | 2003-52584 | 2/2003 |
| JP | 2003-339590 | 12/2003 |
| JP | 2004-267452 | 9/2004 |
| JP | 2005-66034 | 3/2005 |
| JP | 2005-168796 | 6/2005 |
| JP | 2005-230514 | 9/2005 |
| WO | WO-99/27834 | 6/1999 |
| WO | WO-2006/080383 | 8/2006 |
| WO | WO-2006/098965 | 9/2006 |
| WO | WO-2009/149722 | 12/2009 |

OTHER PUBLICATIONS

GB Search Report dated Sep. 8, 2009, directed to GB Application No. 0909898.9; 1 page.

Follows et al., U.S. Office Action mailed Jun. 13, 2012, directed to U.S. Appl. No. 12/791,659; 12 pages.

Follows et al., U.S. Office Action mailed Jun. 13, 2012, directed to U.S. Appl. No. 12/791,470; 8 pages.

Information on Surface Resistivity; Plastics International.com found on internet wayback machine at: http://web.archive.org/web/20090502001116/http://plasticsintl.com/esd.htm dated Mar. 31, 2009; 2 pages.

Follows, T. et al., Office Action mailed Jun. 4, 2012, directed to U.S. Appl. No. 12/791,574; 13 pages.

* cited by examiner

CLEANER HEAD

REFERENCE TO RELATED APPLICATIONS

This application claims the priority of United Kingdom Application No. 0909898.9, filed Jun. 9, 2009, the entire contents of which are incorporated herein by reference.

FIELD OF THE INVENTION

The present invention relates to agitating apparatus for a surface treating appliance, and to a cleaner head for a surface treating appliance. In its preferred embodiment, the present invention relates to a cleaner head for a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening. The dirt-bearing air is conveyed to the separating apparatus so that dirt and dust can be separated from the air before the air is expelled to the atmosphere.

The suction opening is directed downwardly to face the floor surface to be cleaned. The separating apparatus can take the form of a filter, a filter bag or, as is known, a cyclonic arrangement. The present invention is not concerned with the nature of the separating apparatus and is therefore applicable to vacuum cleaners utilizing any of the above arrangements or another suitable separating apparatus.

A driven agitator, usually in the form of a brush bar, is supported in the cleaner head so as to protrude to a small extent from the suction opening. The brush bar is activated mainly when the vacuum cleaner is used to clean carpeted surfaces. The brush bar comprises an elongate cylindrical core bearing bristles which extend radially outward from the core. The brush bar may be driven by an air turbine or by an electric motor powered by a power supply derived from the main body of the cleaner. The brush bar may be driven by the motor via a drive belt, or may be driven directly by the motor, so as to rotate within the suction opening. Rotation of the brush bar causes the bristles to sweep along the surface of the carpet to be cleaned to loosen dirt and dust, and pick up debris. The suction of air causes air to flow underneath the sole plate and around the brush bar to help lift the dirt and dust from the surface of the carpet and then carry it from the suction opening through the cleaner head towards the separating apparatus.

SUMMARY OF THE INVENTION

The bristles of the brush bar are usually formed from nylon, and are usually arranged in tufts arranged about the core of the brush bar. While the use of nylon bristles provides an acceptable cleaning performance on carpeted floor surfaces, we have found that the use of nylon bristles generates static electricity when the floor tool is used on some hard floor surfaces, such as laminate, wood and vinyl surfaces, which attracts fine dust and powders, such as talcum powder, on to the floor surface. This can impair the cleaning performance on the cleaner head on such floor surfaces, as the sweeping action of the nylon bristles is insufficient to overcome the force attracting the fine dust to the floor surface.

The bristle tufts have conventionally been mechanically secured to the brush bar core by individual staples. As a brush bar normally comprises at least forty bristle tufts, the use of staples can increase undesirably the cost of manufacture of the brush bar, particularly when it is desired to increase the number of bristle tufts to improve the agitating performance of the brush bar. It is therefore, desirable to provide an alternative, cheaper technique for attaching at least some of the agitating members, such as bristles, to a brush bar or other agitating apparatus.

In a first aspect, the present invention provides agitating apparatus for a surface treating appliance, comprising a rotatable body having a plurality of grooves formed therein, an agitating member located within each groove so that at least one side edge of the agitating member protrudes outwardly from the body, and a connecting member located within each groove for connecting the agitating member to the body.

The surface resistivity of the agitating members is preferably in the range from $1\times10^{-5}$ to $1\times10^{12}$ Ω/sq (ohms per square). Values of surface resistivity discussed herein are as measured using the test method ASTM D257. The selection of material having a surface resistivity in this range can ensure that any static electricity on the floor surface is effectively discharged by the agitating members upon contact between the agitating members and the floor surface. This enables fine dust and powder which would otherwise be attracted to the floor surface to be dislodged from the floor surface by the agitating members.

Each agitating member is preferably formed from one of metallic, carbon fiber, carbon composite, conductive acrylic, or other composite material. For example, material comprising carbon particles and carbon fibers generally has a surface resistivity in the range from $1\times10^{3}$ to $1\times10^{6}$ Ω/sq, whereas metallic material generally has a much lower surface resistivity, generally lower than 1 Ω/sq. Other static dissipative materials generally have a surface resistivity in the range from $1\times10^{5}$ to $1\times10^{12}$ Ω/sq.

Each agitating member is preferably flexible and is preferably in the form of a strip which may comprise a plurality of bristles, filaments or one or more strips of flexible material. Where the agitating members comprise at least one strip of material, each row is preferably formed from a single strip of material, or from a plurality of adjoining strips. Where the agitating members comprise a plurality of bristles or filaments, the bristles are arranged within each strip so that tips of the bristles are located along said at least one side edge. The bristles are preferably formed from carbon fiber or conductive acrylic fibers, such as Thunderon®. The bristles are preferably arranged in a closely packed formation so that each row of bristles is substantially continuous. For example, each strip preferably contains in the range from 20 to 100 bristles per mm length of the strip, and preferably has a thickness in the range from 0.25 to 2 mm. The diameter of each bristle is preferably in the range from 5 to 20 μm.

The bristles may be connected, for example by stitching or using an adhesive, to an elongate carrier member so that individual or clumps of bristles do not come loose from the strip. For example, each agitating member may be in the form of a brush, with the bristles of each brush extending outwardly from the body, preferably so that the tips of the bristles are evenly spaced from the outer surface of the body.

As mentioned above, the rotatable body has a plurality of grooves formed therein, and the apparatus comprises a plurality of connecting members, each of which is received within a respective groove to connect an agitating member to the body so that at least one side edge of the agitating member protrudes outwardly from the body. This can simplify manufacture of the agitating apparatus, and so reduce costs, as only one connecting member is required for, for example, a row of agitators extending along the brush bar. When the agitating members are formed from flexible material, the shape of the grooves defines the shape adopted by the portions of the agitating members which protrude outwardly from the body. For example, the grooves are preferably curved, more preferably at least partially helical, and so the agitating members adopt a shape which is at least partially helical when they are located within the grooves.

Each agitating member is preferably sandwiched between the body and a respective connecting member along its length. When the agitating members are formed from strips of bristles or filaments, this can prevent individual or clumps of bristles from being pulled out of the body. The connecting members preferably have substantially the same shape as the grooves, and preferably have an outer surface which is substantially flush with the outer surface of the body. For example, if the body is in the form of a cylinder then the outer surfaces of the connecting members preferably have substantially the same radius of curvature as the outer surface of the body. The connecting members may be connected to the body by one of a variety of different techniques, for example by using screws, interference fits or an adhesive.

Each agitating member may be located within its respective groove so that only one of the side edges protrudes outwardly from the body, or so that both of the opposing side edges of the agitating member protrude outwardly from the body. This can enable, for example, the number of times that the agitating member engages a floor surface with each revolution of the body to be increased without having to increase the number of agitating members. In this latter case, the angle between the side edges of the agitating members, when connected to the body, is preferably less than 180°, and is preferably in the range from 45 to 135°.

The rotatable body may comprise further surface agitating means. The agitating apparatus may thus comprise two different surface agitating means. The further surface agitating means are preferably located between the grooves of the body. Preferably, the agitating members protrude radially outwardly from the body beyond the further surface agitating mean, for example by a distance in the range from 0.5 to 5 mm, more preferably by a distance in the range from 1 to 3 mm.

The relatively short, further surface agitating means may be configured to agitate dirt and dust from a carpeted floor surface, whereas the agitating members may be configured to sweep dirt and dust from a hard floor surface. The further surface agitating means is thus preferably relatively stiff in comparison to the agitating members. For example, bristles or filaments of the further surface agitating means may have a greater diameter than bristles or filaments of the agitating members. Alternatively, one or more strips of material forming the further surface agitating means may have a greater thickness than strips of material forming the agitating members.

The further surface agitating means may be formed from electrically insulating, plastics material, such as nylon, and so may have a surface resistivity which is different to that of the agitating members. The surface resistivity of the further surface agitating means is preferably in the range from $1\times10^{12}$ to $1\times10^{16}$ Ω/sq. Alternatively, the further surface agitating means may be formed from a similar material as the agitating members, and so may have a surface resistivity within the aforementioned range for the agitating members, in order to discharge any static electricity residing on a carpeted floor surface.

The further surface agitating means is preferably arranged in a plurality of rows along the body, with these rows being preferably discontinuous. For example, where the further surface agitating means comprises a plurality of bristles these bristles are preferably arranged in one or more rows of clusters or tufts of bristles connected to and spaced along the body. However, the further surface agitating means may be located within, or otherwise in contact with, the agitating members. For example, each of the agitating means may comprises a plurality of bristles or filaments, with the bristles or filaments of the further surface agitating means being located adjacent, or amongst, bristles or filaments of the agitating members.

The agitating apparatus is preferably in the form of a rotatable brush bar.

In a second aspect, the present invention provides a cleaner head for a surface treating appliance, the cleaner head comprising a housing and apparatus as aforementioned. The cleaner head preferably comprises a sole plate having a suction opening through which dirt-bearing air enters the cleaner head, and through which the agitating members protrude as the body is rotated during use of the cleaner head, and a plurality of support members, preferably in the form of rolling elements, such as wheels or rollers, rotatably mounted on the sole plate, for supporting the cleaner head on a surface to be cleaned.

In a third aspect, the present invention provides a surface treating appliance comprising a cleaner head or agitating apparatus as aforementioned.

The term "surface treating appliance" is intended to have a broad meaning, and includes a wide range of machines having a main body and a head for travailing over a surface to clean or treat the surface in some manner. It includes, inter alia, machines which simply agitate the surface, such as carpet sweepers, machines which only apply suction to the surface, such as vacuum cleaners (dry, wet and wet/dry), so as to draw material from the surface, and machines which apply material to the surface, such as polishing/waxing machines, pressure washing machines and shampooing machines.

Features described above in connection with the first aspect of the invention are equally applicable to any of the second to third aspects of the invention, and vice versa.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
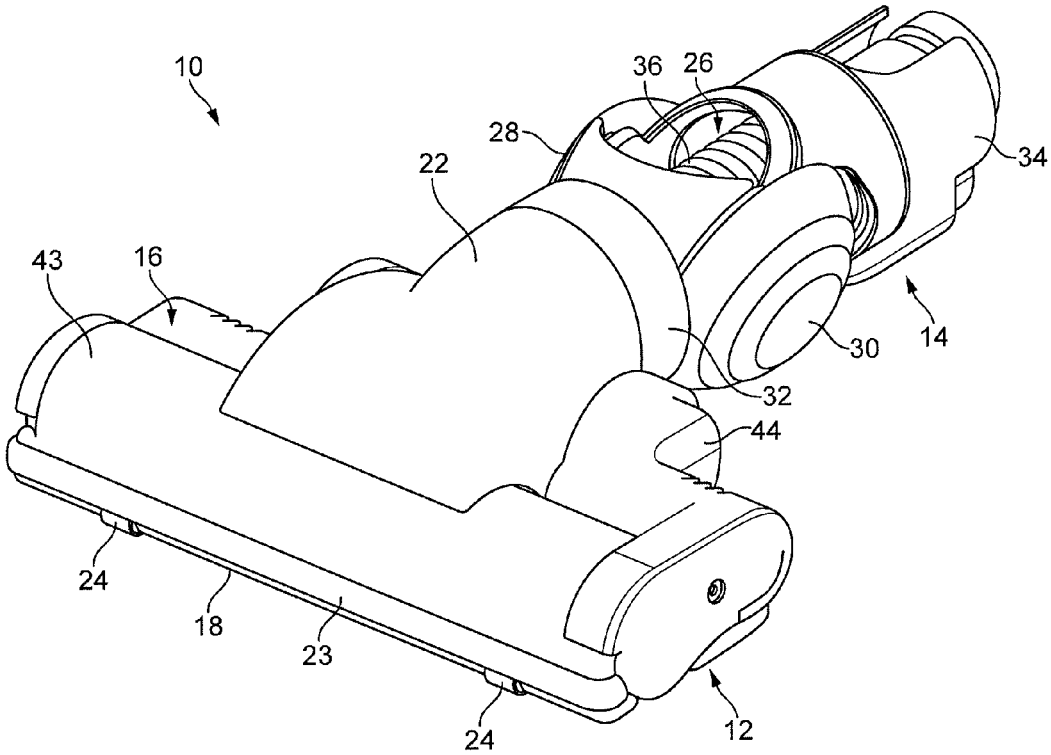
FIG. 1 is a front perspective view, from above, of a floor tool.
Figure 2:
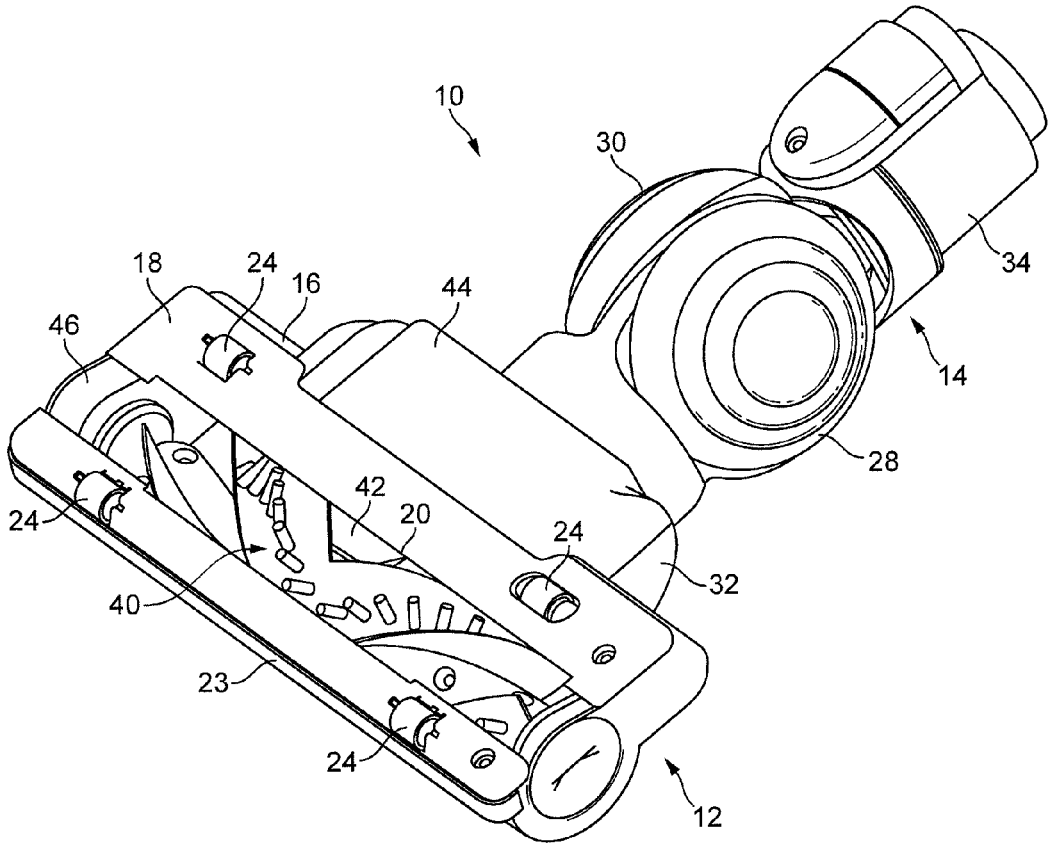
FIG. 2 is a front perspective view, from below, of the floor tool of FIG. 1.
Figure 3:
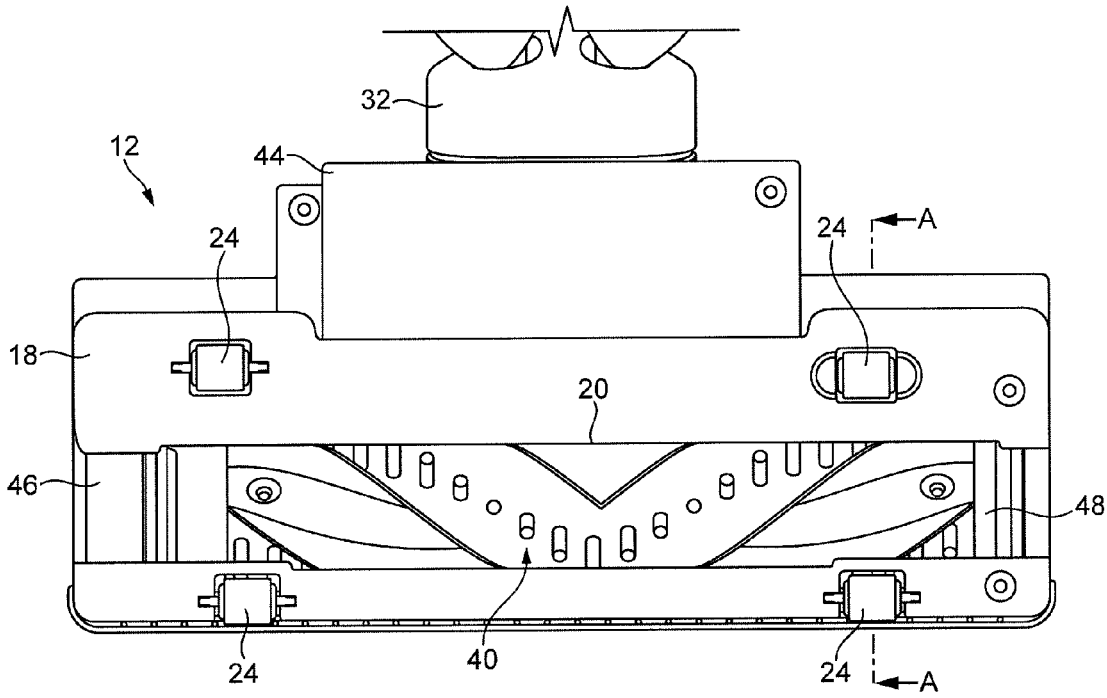
FIG. 3 is a bottom view of the floor tool of FIG. 1.

With reference first to FIGS. 1 to 3, a floor tool 10 comprises a cleaner head 12 rotatably attached to a coupling 14.

Figure 7:
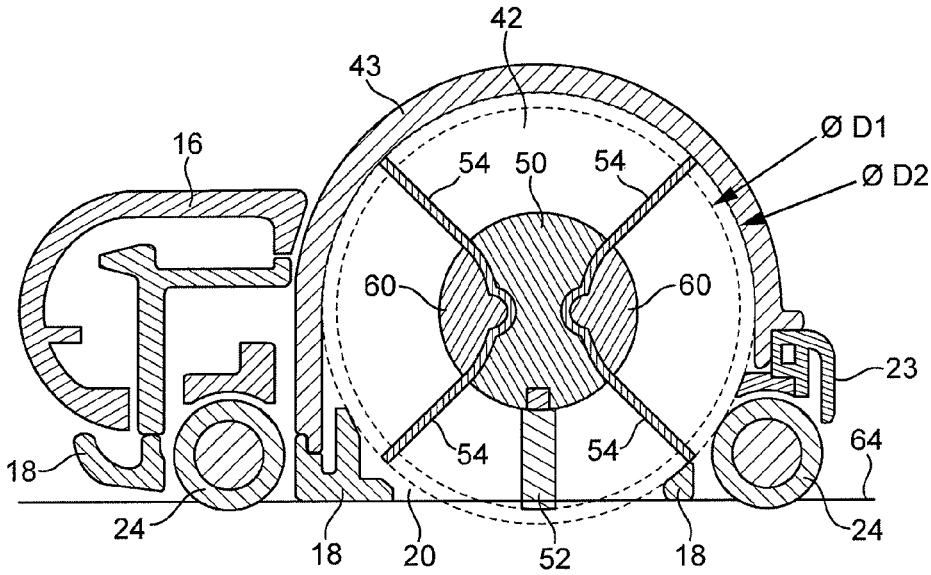
FIG. 7 is a section taken along line A-A illustrated in FIG. 3 when the floor tool is located on a carpeted floor surface.
Figure 8:
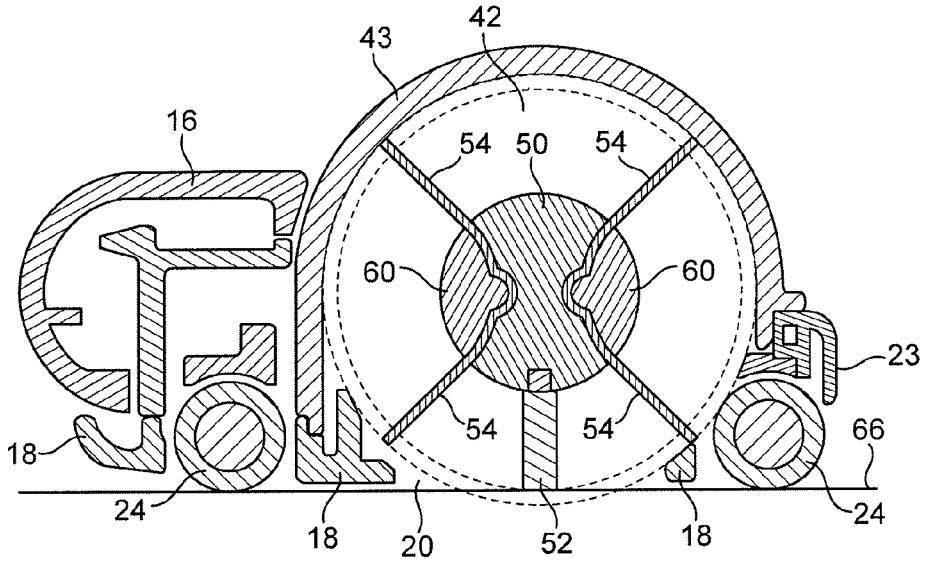
FIG. 8 is a section taken along line A-A illustrated in FIG. 3 when the floor tool is located on a hard floor surface.

The free end of the coupling 14 is attachable to a wand, hose or other such duct of a cleaning appliance (not shown). The cleaner head 12 comprises a housing 16 and a lower plate, or sole plate 18, comprising a suction opening 20 through which a dirt-bearing fluid flow enters the cleaner head 12. The housing 16 defines a suction passage extending from the suction opening 20 to an outlet duct 22 located at the rear of the housing 16. The housing 16 preferably comprises a front bumper 23. The sole plate 18 comprises a plurality of support members 24 in the form of rolling elements mounted within recessed portions of the sole plate 18 for supporting the cleaner head 12 on a floor surface. With reference to FIGS. 7 and 8, the support members 24 are preferably arranged to support the sole plate 18 above the floor surface when the cleaner head 12 is located on a hard floor surface 66, and, when the cleaner head 12 is located on a carpeted floor surface 64, to sink into the pile of the carpet to enable the bottom surface of the sole plate 18 to engage the fibers of the carpet. The sole plate 18 is preferably pivotable relative to the housing 16 to allow the sole plate 18 to ride smoothly over the carpeted floor surface 64 during cleaning.

The coupling 14 comprises a conduit 26 supported by a pair of wheels 28, 30. The conduit 26 comprises a forward portion 32 connected to the outlet duct 22, a rearward portion 34 pivotably connected to the forward portion 32 and connectable to a wand, hose or other such duct of a cleaning appliance which comprises dirt and dust separating apparatus and a motor-driven fan unit for drawing dirt-bearing air through the suction opening 20 from the floor surface. A flexible hose 36 is held within and extends between the forward and the rearward portions 32, 34 of the conduit 26.

The cleaner head 12 comprises agitating apparatus for agitating dirt and dust located on the floor surface. In this example the agitating apparatus comprises a rotatable brush bar 40 which is mounted within a brush bar chamber 42 of the housing 16. The brush bar chamber 42 is partially defined by a generally semi-cylindrical portion 43 of the housing 16, which is preferably formed from transparent material. The brush bar 40 is driven by a motor (not shown) located in a motor housing 44 of the housing 16. The motor is electrically connected to a terminal located in the rearward portion 34 of the conduit 26 for connection with a conformingly profiled terminal located in a duct of the cleaning appliance to enable electrical power to be supplied to the motor.

The brush bar 40 is connected to the motor by a drive mechanism located, at least in part, within a drive mechanism housing 46 so that the drive mechanism is isolated from the air passing through the suction passage. One end of the brush bar 40 is connected to the drive mechanism to enable the brush bar 40 to be driven by the motor, whereas the other end of the brush bar 40 is rotatably supported by an end cap 48 mounted on a side wall of the brush bar chamber 42.

Figure 4:
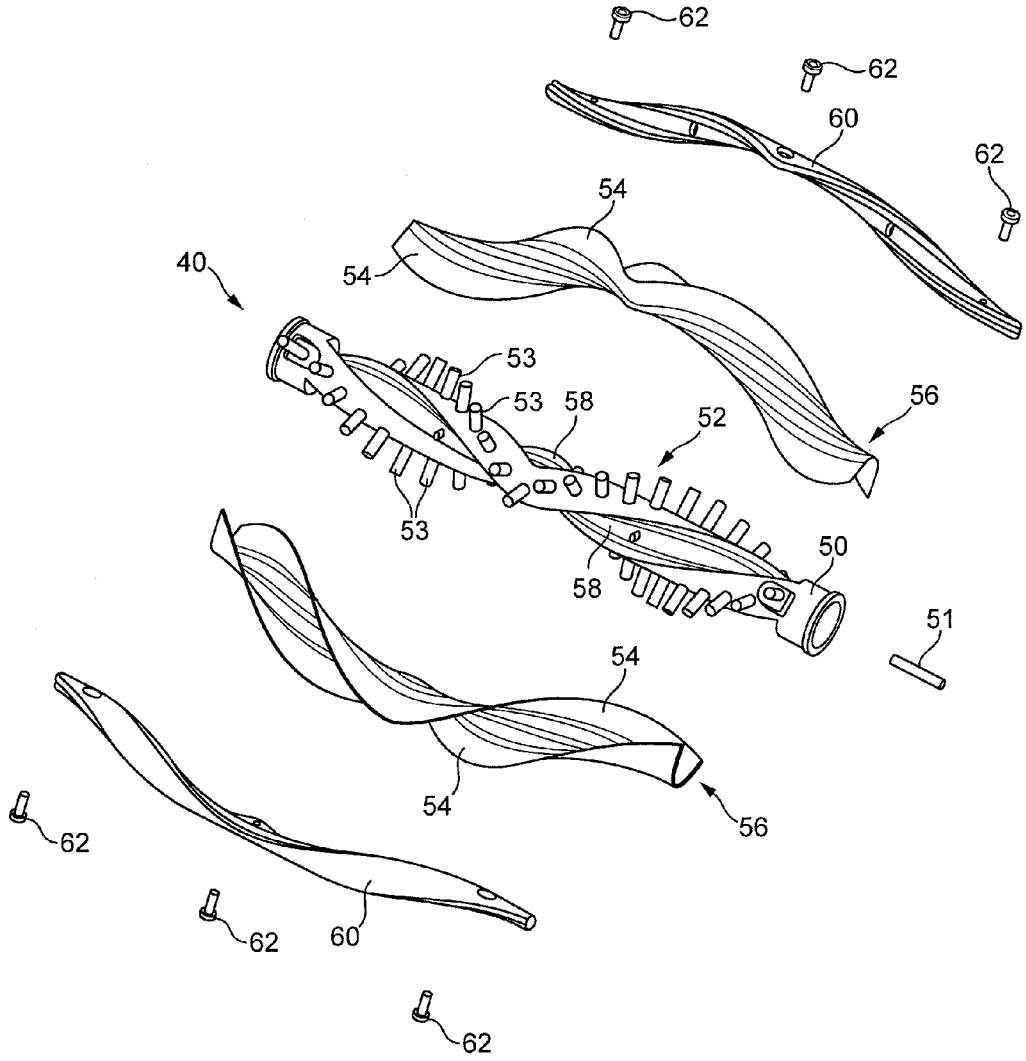
FIG. 4 is an exploded view of the brush bar of the floor tool of FIG. 1.
Figure 5:
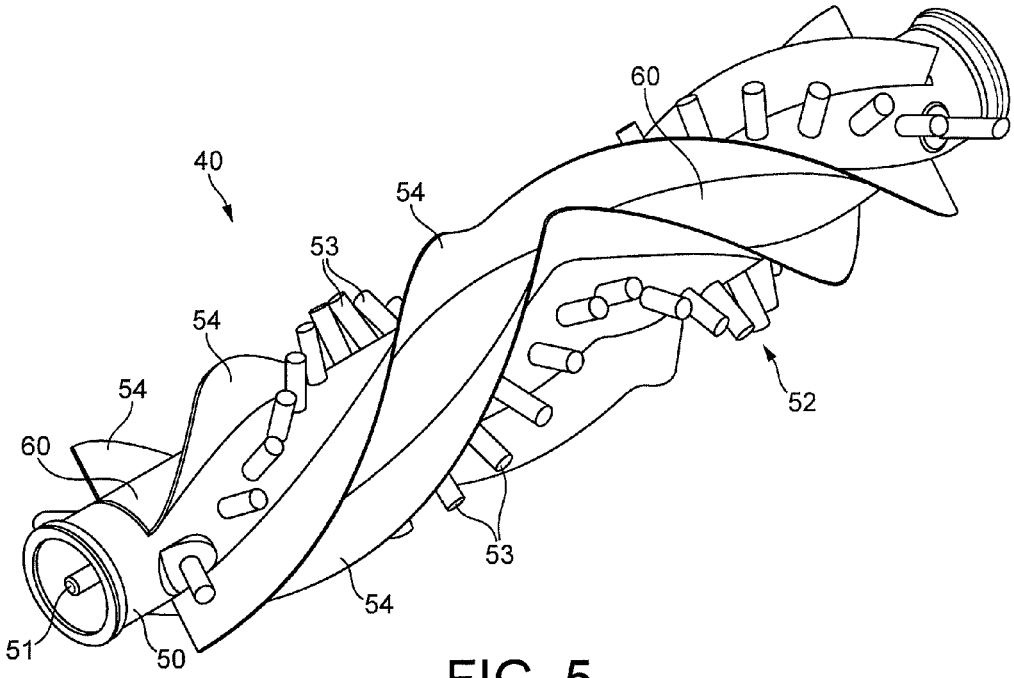
FIG. 5 is a perspective view of the brush bar of FIG. 4.
Figure 6:
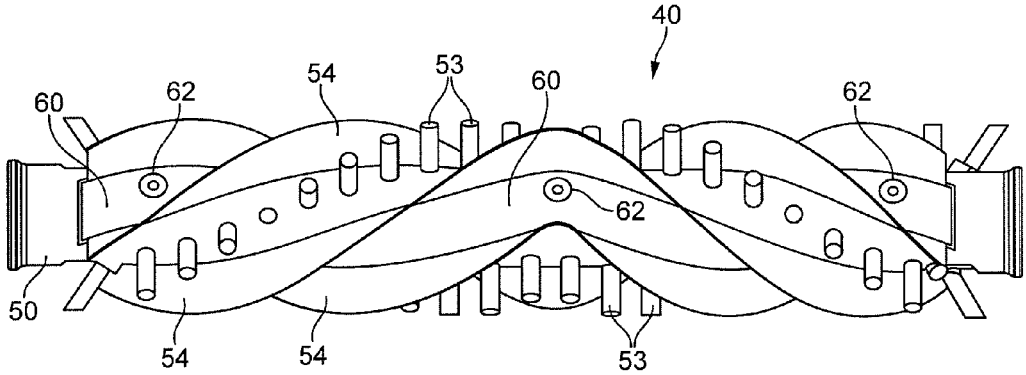
FIG. 6 is a top view of the brush bar of FIG. 4.

The brush bar 40 is illustrated in more detail in FIGS. 4 to 6. The brush bar 40 comprises an elongate body 50 bearing two different types of agitating means for agitating dirt and dust from the floor surface as the brush bar 40 is rotated by the motor. Each of the different types of agitating means protrudes from the suction opening 20 in the sole plate 18 as the brush bar 40 is rotated by the motor. A spindle 51 is mounted on one end of the body 50, with the spindle 51 being in turn connected to the end cap 48.

A first agitating means mounted on the body 50 of the brush bar 40 comprises relatively short, preferably relatively stiff, bristles 52. These bristles 52 are preferably formed from nylon. In this embodiment the relatively short bristles 52 are arranged in two angularly spaced, helical rows extending along the body 50. Within each row, the relatively short bristles 52 are arranged in a series of clusters or tufts 53 regularly spaced along the row. Each tuft 53 preferably comprises around 100 to 150 bristles, with each tuft 53 having a diameter in the range from 2 to 4 mm. The diameter of each bristle 52 is preferably in the range from 100 to 200 μm. The length of the relatively short bristles 52 is chosen so that, when the floor tool 50 is assembled, the tips of these bristles 52 do not protrude beneath a plane extending between the lowermost extremities of the support members 24 during rotation of the brush bar 40.

A second agitating means mounted on the body 50 of the brush bar 40 comprises relatively long, preferably relatively soft, bristles 54. As illustrated in FIG. 7, the relatively long bristles 54 protrude radially outwardly from the body 50 beyond the relatively short bristles 52. During rotation of the body 50, the relatively short bristles 52 sweep a cylindrical volume having a diameter D1, whereas the relatively long bristles 54 sweep a cylindrical volume having a diameter D2 which is greater than D1. The difference between D1 and D2 is preferably in the range from 1 to 10 mm, more preferably in the range from 2 to 6 mm. In contrast to the relatively short bristles 52, the length of the relatively long bristles 54 is chosen so that the relatively long bristles 54 protrude beyond the plane extending between the lowermost extremities of the support members 24 during rotation of the brush bar 40.

The relatively long bristles 54 are formed from material having a lower surface resistivity than the material from which the relatively short bristles 52 are formed. The surface resistivity of the relatively long bristles 54 is preferably in the range from $1\times10^{-5}$ to $1\times10^{12}$ Ω/sq. In comparison, the surface resistivity of the relatively short bristles 52 is preferably higher than $1\times10^{12}$ Ω/sq. The relatively long bristles 54 may be formed from electrically conductive material. The bristles may be formed from metallic, graphite, conductive acrylic or other composite material, but in this example the relatively long bristles 54 comprise carbon fiber bristles. The diameter of each bristle 54 is preferably in the range from 5 to 20 μm.

The body 50 comprises a plurality of angularly spaced, continuous rows of the relatively long bristles 54, which preferably also extend helically along the body 50. In this embodiment the body 50 comprises four continuous rows of the relatively long bristles 54, with each row being angularly spaced from a row of tufts 53 formed from the relatively short bristles 52. Each row of the relatively long bristles 54 preferably contains in the range from 20 to 100 bristles per mm length, and has a thickness in the range from 0.25 to 2 mm.

With particular reference to FIG. 4, in this embodiment adjacent rows of the relatively long bristles 54 are formed from a single strip 56 of bristles. Each strip 56 is preferably formed by attaching an elongate, generally rectangular flexible carrier member to a row of bristles so that each row of bristles 54 protrudes outwardly from a respective long side edge of the carrier member. The carrier member may be attached to the row of bristles by stitching or by using an adhesive. Each strip 56 is then located within a respective helical groove 58 formed in the body 50 so that the ends of the bristles protrude outwardly from the body 50. The strips 56 are connected to the body 50 by helical connectors 60 which are mounted on the strips 56 and connected to the body 50 using screws 62 into apertures formed in the connectors 60. The screws 62 may be pushed through the carrier member, or inserted through apertures formed in the carrier member. An adhesive tape may be applied to at least one side of each carrier member to allow the strips 56 to be aligned within the grooves 58 so that the ends of the bristles protrude from the body 50 by a regular amount along the length of the body 50.

With reference to FIG. 7, when the cleaner head 12 is located on a carpeted floor surface 64 the support members 24 sink into the pile of the carpet so that the bottom surface of the sole plate 18 engages the fibers of the carpet. As both the relatively short bristles 52 and the relatively long bristles 54 protrude from the suction opening 20 as the brush bar 40 rotates, both the different types of bristles are able to agitate dirt and dust from the floor surface. When an air flow is generated through the suction passage of the cleaner head 12, this dirt and dust becomes entrained within the air flow and is conveyed through the floor tool 10 to the cleaning appliance.

When the cleaner head 12 is moved from the carpeted floor surface 64 on to a hard floor surface 66, as illustrated in FIG. 8, the sole plate 18 becomes spaced from the hard floor surface 66. As the tips of the relatively short bristles 52 do not protrude beneath the plane extending between the lowermost extremities of the support members 24, these bristles do not come into contact with the hard floor surface 66, thereby preventing scratching or other marking of the hard floor surface 66 by these bristles. However, as the relatively long bristles 54 protrude beyond this plane, these bristles engage, and are swept across, the hard floor surface 66 with rotation of the brush bar 40. Due to the relatively low surface resistivity of the relatively long bristles 54, any static electricity residing on the hard floor surface 66 is discharged upon contact with the relatively long bristles 54, thereby enabling fine dust and powder which would otherwise be attracted to the hard floor surface 66 to be dislodged from the floor surface by these bristles and entrained within the air flow.

The invention is not limited to the detailed description given above. Variations will be apparent to the person skilled in the art.

For example, in the embodiment described above, the cleaner head 12 includes a brush bar 40 that is driven by a motor. However, the cleaner head 12 may include alternative means for agitating or otherwise working a surface to be cleaned. By way of example, the brush bar 40 may be driven by an air turbine rather than a motor.

The relatively short bristles 52 may be formed from similar material as the relatively long bristles 54 in order to discharge any static material residing on a carpeted floor surface, and so may also have a surface resistivity in the range from $1\times10^{-5}$ to $1\times10^{12}$ Ω/sq.

Figure 9:
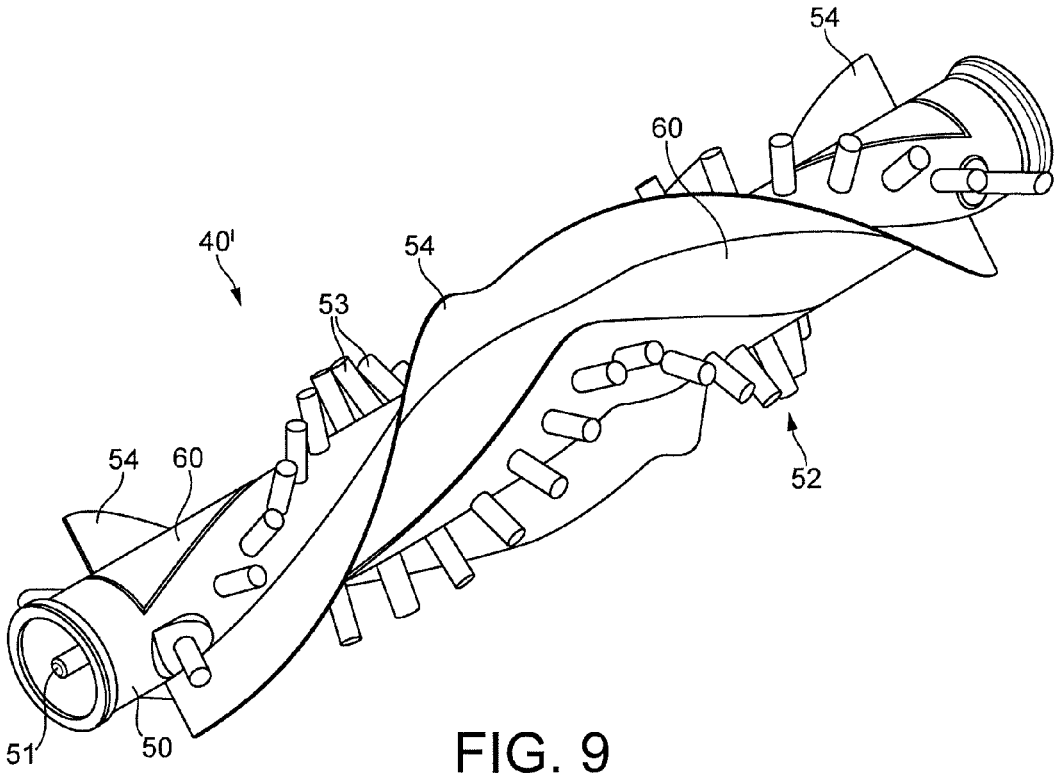
FIG. 9 is a perspective view of a modified version of the brush bar of FIG. 4.

Each strip 56 may be modified so that the bristles protrude from only one of the relatively long side edges of the carrier member. Thus, each strip 56 may be in the form of a brush, with bristles extending outwardly from only one side of the brush. A modified version of the brush bar 40', in which each strip 56 has been modified as discussed above, is illustrated in FIG. 9. This modification of the strips 56 results in the bristles 54 protruding outwardly from one side only of each connecting member 60. Consequently, this brush bar 40' contains only two continuous rows of relatively long bristles 54, with the rows of tufts 53 and the rows of relatively long bristles 54 being alternately arranged about the body 50 of the brush bar 40'. As with the brush bar 40, the relatively long bristles 54 protrude radially outwardly from the body 50 beyond the relatively short bristles 52.

The different types of bristles 52, 54 need not be spaced apart. The brush bar 40 may comprise a plurality of rows, clumps or tufts of bristles, with each row, clump or tuft comprising both types of bristles. For example, relatively short bristles 52 may be dispersed within each row of relatively long bristles 54. Alternatively, relatively long bristles 54 may be dispersed within each tuft 53 of relatively short bristles 52.

The agitating means may take forms other than bristles, such as flexible or rigid strips of material mounted on the body 50, or filaments sewn into a backing material connected to the body 50.

In the event that the floor tool 10 is not to be used on a carpeted surface, the relatively short bristles 52 may be dispensed with so that the brush bar 40 comprises only electrically conductive agitating members. Consequently, the brush bar 40 may comprise solely the continuous rows of surface agitating members defined by the relatively long bristles 54 illustrated in FIGS. 2 to 8. Alternatively, the brush bar 40 may comprise a different arrangement of surface agitating members for discharging static electricity residing on a floor surface.

Figure 10:
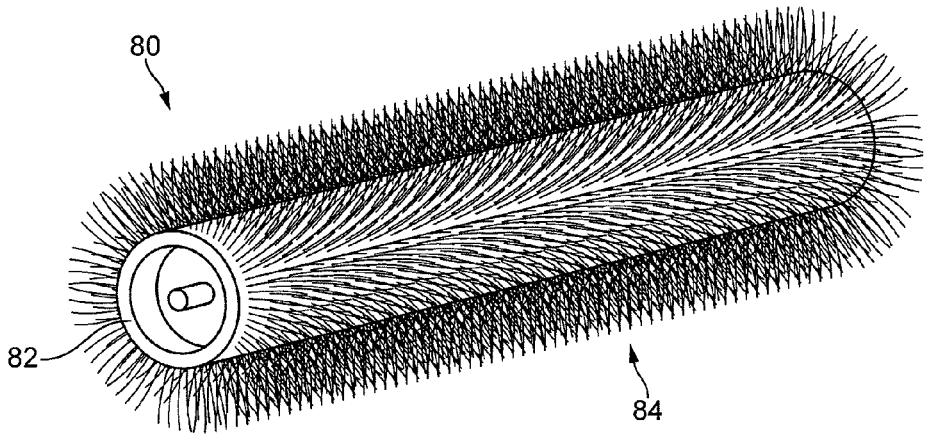
FIG. 10 is a perspective view of an alternative brush bar for use with the floor tool of FIG. 1.

For example, with reference to FIG. 10 an alternative brush bar 80 for use in the floor tool 10 comprises a rotatable body 82 having an outer surface comprising an electrically conductive pile 84. In this example, the pile 84 is similar to the raised or fluffy surface of a carpet, rug or cloth, and comprises filaments woven on to a fabric carrier member 86 attached to the body 82, for example using an adhesive. The length of the filaments of the pile 84 is preferably in the range from 4 to 15 mm, and the filaments have a diameter which is preferably in the range from 5 to 20 μm.

These filaments are preferably formed from carbon fibers, but alternatively they may be formed from metallic material, conductive acrylic material or other composite material. Consequently, the surface resistivity of the filaments of the pile 84 is preferably in the range from $1\times10^{-5}$ to $1\times10^{12}$ Ω/sq. The fabric carrier member 86 may be in the form of a strip wound on to the body 82 so that the pile 84 is substantially continuous, substantially covering the outer surface of the body 82. Alternatively, the carrier member 86 may be in the form of a cylindrical sleeve into which the body 82 is inserted.

If so desired, clumps of relatively stiff bristles may be dispersed within the pile 84. Alternatively, a strip of the pile 84 may be wound around one or more helical rows of relatively stiff bristles previously attached to the body 82. These bristles may be similar to the relatively short bristles 52 of the brush bar 40, and so may be arranged so as to not protrude radially outwardly beyond the filaments of the pile 84.

The invention claimed is:

1. An agitating apparatus for a surface treating appliance, comprising a rotatable body having a plurality of grooves formed therein, an agitating member located within each groove so that at least one side edge of the agitating member protrudes outwardly from the body, and a connecting member located within each groove for connecting the agitating member to the body, wherein each agitating member is in the form of a flexible strip of bristles, and the agitating member is clamped between the body and a respective connecting member along the length thereof.

2. The agitating apparatus of claim 1, wherein the surface resistivity of each agitating member is in the range from $1\times10^{-5}$ to $1\times10^{12}$ Ω/sq.

3. The agitating apparatus of claim 1, wherein each agitating member is formed from one of metallic, carbon fiber, conductive acrylic and composite material.

4. The agitating apparatus of claim 1, wherein each groove is at least partially helical.

5. The agitating apparatus of claim 1, wherein an outer surface of the connecting member is substantially flush with the outer surface of the body.

6. The agitating apparatus of claim 1, wherein each agitating member is located within its respective groove so that opposing side edges of the agitating member protrude outwardly from the body.

7. The agitating apparatus of claim 1, wherein each strip contains in the range from 20 to 100 bristles per mm length of the strip.

8. The agitating apparatus of claim 1, wherein the bristles have a diameter in the range from 5 to 20 μm.

9. The agitating apparatus of claim 1, wherein each strip has a thickness in the range from 0.25 to 2 mm.

10. The agitating apparatus of claim 1, wherein the rotatable body comprises further surface agitating members.

11. The agitating apparatus of claim 10, wherein the further surface agitating members are located between the grooves of the body.

12. The agitating apparatus of claim 10, wherein the further agitating members are arranged in a plurality of rows along the body.

13. The agitating apparatus of claim 12, wherein the rows of further agitating members are discontinuous.

14. The agitating apparatus of claim 10, wherein the further surface agitating members comprise one of a plurality of bristles, a plurality of filaments, and at least one strip of material.

15. The agitating apparatus of claim 1, in the form of a rotatable brush bar.

16. A cleaner head for a surface treating appliance comprising the agitating apparatus of claim 1.

17. The agitating apparatus of claim 1, wherein the connecting member is connected to the body.

18. The agitating apparatus of claim 1, wherein the connecting member is located within each groove over the agitating member.

* * * * *